United States Patent [19]

Block et al.

[11] 4,439,907

[45] Apr. 3, 1984

[54] METHOD OF MAKING AN ABRASIVE DISC

[75] Inventors: Aleck Block, Los Angeles; Arthur F. Carlson, South Gate, both of Calif.

[73] Assignee: Merit Abrasive Products, Inc., Compton, Calif.

[21] Appl. No.: 363,248

[22] Filed: Mar. 29, 1982

Related U.S. Application Data

[60] Division of Ser. No. 223,167, Jan. 7, 1981, which is a continuation-in-part of Ser. No. 55,630, Jul. 9, 1979, abandoned.

[51] Int. Cl.[3] ..... B23P 11/00

[52] U.S. Cl. ..... 29/432.1; 29/798; 51/358; 51/389; 411/179; 411/181; 411/187

[58] Field of Search ..... 29/432, 432.1, 798; 411/183–185, 179, 181, 187, 188; 51/358, 389

[56] References Cited

U.S. PATENT DOCUMENTS

| | | | |
|---|---|---|---|
| 1,928,800 | 10/1933 | Stever | 51/358 |
| 3,086,421 | 4/1963 | Hamman | 29/432 X |
| 3,177,915 | 4/1965 | LaFleur et al. | 411/181 |
| 3,212,819 | 10/1965 | Churchill | 29/432 X |
| 3,216,758 | 11/1965 | Bohlen | 29/432 X |
| 3,250,047 | 5/1966 | Block | 51/358 |
| 3,274,638 | 9/1966 | Bien | 411/179 X |
| 3,281,171 | 10/1966 | Hughes | 411/179 X |
| 3,747,286 | 7/1973 | Haigh | 51/389 |

FOREIGN PATENT DOCUMENTS

| | | |
|---|---|---|
| 1343682 | 1/1974 | United Kingdom . |
| 1352876 | 5/1974 | United Kingdom . |
| 1352877 | 5/1974 | United Kingdom . |

*Primary Examiner*—Charlie T. Moon

*Attorney, Agent, or Firm*—Ellsworth R. Roston; Charles H. Schwartz

[57] ABSTRACT

An abrasive disc includes a rotatable sheet. Abrasive particles are disposed on a first side of the sheet to provide an abrasive action. Coupled to the sheet means are (1) a first portion defining at least one internal thread in spaced relationship to the opposite surface of the sheet for threaded coupling with an externally threaded mandrel, (2) a second portion extending from the first portion along the opposite surface of the sheet and providing a transmittal of force from the first portion and (3) a third portion extending from the second portion into coupled relationship with the sheet and receiving the transmitted force and providing a force for driving the sheet means. The first portion of the coupling defines a boss disposed on the opposite surface of the sheet in spaced relationship to the sheet and having an opening operative as a single-turn internal thread. The second portion of the coupling defines a flange disposed against the opposite surface of the sheet in a frictional, but non-adhering, relationship with the sheet. The third portion extends from the periphery of the second portion and defines drive fingers which extend through the sheet to retain the sheet in a driven relationship. The third portion of the coupling is bent against the abrasive surface of the sheet means. When thus bent, the third portion of the coupling means is disposed in flush relationship with the sheet means because there are no burrs produced on the sheet means when the drive fingers are driven through the sheet means.

8 Claims, 14 Drawing Figures

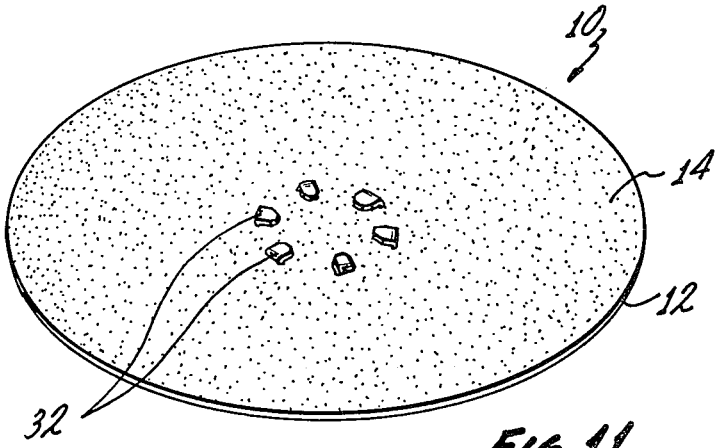
FIG. 11
FIG. 12
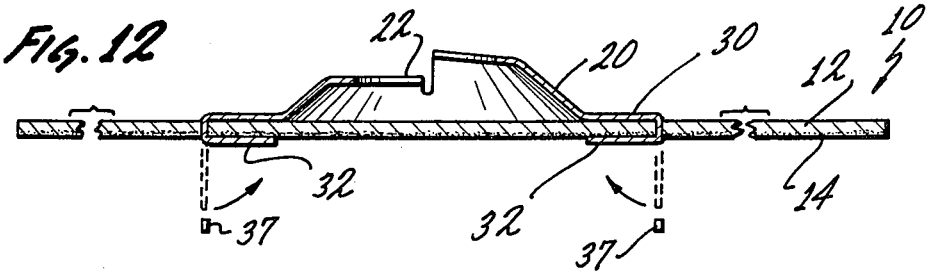
FIG. 13
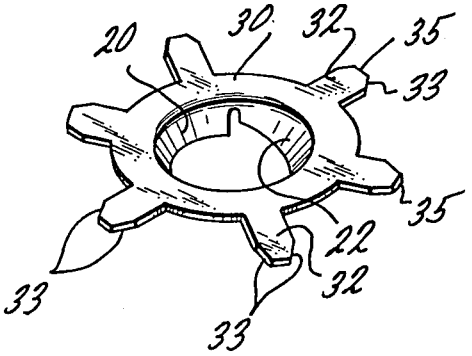
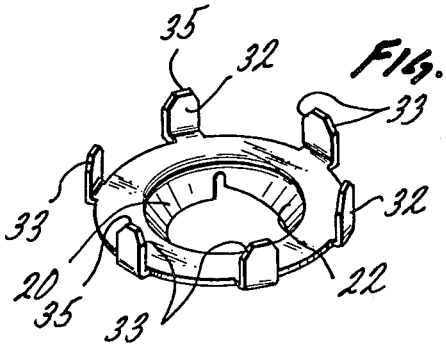
FIG. 14

METHOD OF MAKING AN ABRASIVE DISC

This is a division of application Ser. No. 223,167 filed Jan. 7, 1981, pending, which is in turn a continuation-in-part of application Ser. No. 055,630 filed July 9, 1979, now abandoned.

This invention relates to a coated abrasive disc. More particularly, the invention relates to the general type of coated abrasive disc which is easily assembled and which is easily disassembled even after use and which is capable of withstanding considerable forces by a workpiece during a powered rotation of the disc against a workpiece.

The present invention is directed specifically to providing a disc with an improved coupling means which provides for easy and positive coupling of the disc to a holder and easy uncoupling of the disc from the holder and a reliable resistance of the disc to high forces from a workpiece.

GENERAL STATEMENT

Coated abrasive discs of the general type of this invention comprise four components: (1) a backing sheet of flexible material such as vulcanized fiber, cloth, paper or the like, (2) a coating of adhesive on a first side of the backing sheet, (3) abrasive grains secured to the first side of the backing sheet by means of the adhesive and (4) means central of the disc to couple the disc to a holder. The abrasive discs of this general type now in use have certain disadvantages in regard to the means by which they are coupled to the holder.

PRIOR ART

In perhaps the oldest and most prevalent of this general type of disc, as used in industry in large diameters (such as diameters of 7") with fiber backing sheets, a coupling means consists of a hole in the center of the disc through which a "T" nut with a shoulder is inserted from the abrasive face side of the disc. This nut threadedly engages a threaded mating male fitting in the center of a holder. By compressing the margin of the disc around the center hole between the shoulder of the nut and the central area of the support pad, the disc is held by friction to a pad in the holder and against circumferential movement relative to the support pad. One disadvantage of this coupling system is that the threaded fastener is relatively small and separate and is accordingly susceptible to being dropped and lost by the operator when changing discs. Another disadvantage is that the threaded fastener must be set so tightly to frictionally secure the disc against rotation relative to the pad that a wrench often has to be used to seat and/or unseat the fastener to couple and uncouple the disc from the holder.

A tight coupling between the threaded fastener and the holder is also produced during the operation of the disc. This occurs in part because the margin of the disc around the center hole is composed of a relatively compressible combination of fiber, adhesive coating and abrasive grain. This area of the disc is compressed between the shoulder of the fastener and the central area of the support pad. It accordingly acts as a spring-type lock-washer, resisting the unseating of the fastener. This is another reason why a wrench often has to be used to seat and/or unseat the fastener to couple and uncouple the disc from the holder.

Attempts have been made, as in MacKay U.S. Pat. No. 3,667,170 and 3M U.S. Pat. No. 3,562,968, to provide a disc with a threaded fastener which is adhered by adhesive to the center-back of the disc, thus eliminating the need of a center hole in the disc and the consequent disadvantage of the center-hole locking system. However, the arrangements adhering the fastener to the back of the disc have serious disadvantages. One disadvantage is that the adhesive bonding process is cumbersome and expensive in manufacturing large discs (such as discs with 7" diameter). Another disadvantage is that high torque and high grinding temperatures are developed in using large-diameter discs against workpieces. These high torques, particularly at high temperatures, tend to produce failure of the bond. Attempts have been made to market the bonded-fastener type of disc in large diameters (such as diameters of 7") but the manufacturer has withdrawn this disc from the market and applies this technique only in manufacturing discs of relatively small diameters (such as between 4" diameter and 1" diameter) and now manufactures a 7" quick-change disc as described in the MacKay U.S. Pat. No. 3,667,169.

The disc of U.S. Pat. No. 3,667,169 does not overcome the disadvantages of the plain center-hole disc. This disc uses a sheet metal "T" nut fastener with a single turn to substitute for the conventional solid metal "T" nut. However, the binding problem resulting from the compression of the margin of the center hole of the disc between the nut shoulder and the central area of the support pad is still present.

In view of this binding problem, friction is still present in sufficient degree to require substantial effort on the operator's part to unseat the fastener before the disc can be unscrewed from the holder. To unseat the fastener, the operator generally has to grasp the support pad with one hand, or mechanically lock his power tool arbor against rotation, and grasp the perimeter of the disc with the other hand. Thus using the disc as a wrench, the operator exerts a considerable force to unseat the nut. With the arbor locked, the torque required at the perimeter of a 7" diameter disc is considerable.

Considerable attempts have been made to provide a disc which overcomes the above disadvantages. In spite of the substantial need for such a disc, such attempts have not been successful. The problem has accordingly continued to exist for a substantial number of years.

GENERAL STATEMENT OF INVENTION

This invention provides a disc which overcomes the above difficulties. The disc is constructed to provide a positive engagement with a support holder without compressing the disc and converting the disc, as a practical matter, into a lockwasher. This allows the disc to be easily removed from the support holder after the disc and the support holder have been applied against a workpiece. the disc is further advantageous in that it includes a drive member which retains the abrasive sheet without being adhered to the abrasive sheet or any other member. The disc is also advantageous because only the working portion of the abrasive sheet is positioned to operate upon the workpiece.

The abrasive disc of this invention includes rotatable sheet means. Abrasive particles are disposed on a first surface of the sheet as a means to provide an abrasive action. Means coupled to the sheet means include a first portion defining at least one internal thread in spaced relationship to the opposite surface of the sheet means for threaded coupling with an externally threaded mandrel, a second portion extending from the first portion along the opposite surface of the sheet means and providing a transmittal of force from the first portion and a third portion extending from the second portion into coupled relationship with the sheet means and receiving the transmitted force and providing a force for driving the sheet means.

The first portion of the coupling means may define a boss disposed on the opposite surface of the sheet means in spaced relationship to the sheet means and having an opening operative as a single-turn internal thread. The second portion of the coupling means may define a flange disposed against the opposite surface of the sheet means in a frictional, but non-adhering, relationship with the sheet means. The third portion may extend from the periphery of the second portion and may define drive fingers which extend through the sheet means to retain the sheet means in a driven relationship. The third portion of the coupling means may be bent against the abrasive surface of the sheet means. When thus bent, the third portion of the coupling means is disposed in flush relationship with the sheet means because there are no burrs produced of the sheet means when the drive fingers are driven through the sheet means.

In the drawings:

FIG. 11 is a perspective view of the disc after assembly of the disc when viewing the disc in the direction facing the abrasive surface;

FIG. 12 is a sectional view of the disc and illustrates in broken lines an intermediate step for converting the blank into the drive member;

FIG. 13 is a perspective view of the blank at an initial step in converting the blank into the drive member; and FIG. 14 is a perspective view similar to that shown in FIG. 13 but illustrating the blank at an intermediate stage in converting the blank into the drive member.

DETAILED STATEMENT OF INVENTION

In one embodiment of the invention, a disc generally indicated at 10 is provided. The disc 10 includes sheet means such as a flexible backing member 12. The backing member 12 may be constructed from a suitable material such as a fiberboard to which abrasive particles 16 are attached to one side of the backing member 12. The abrasive particles 16 may be attached to the backing member by a suitable adhesive such as a thermosetting resin.

Figure 9:
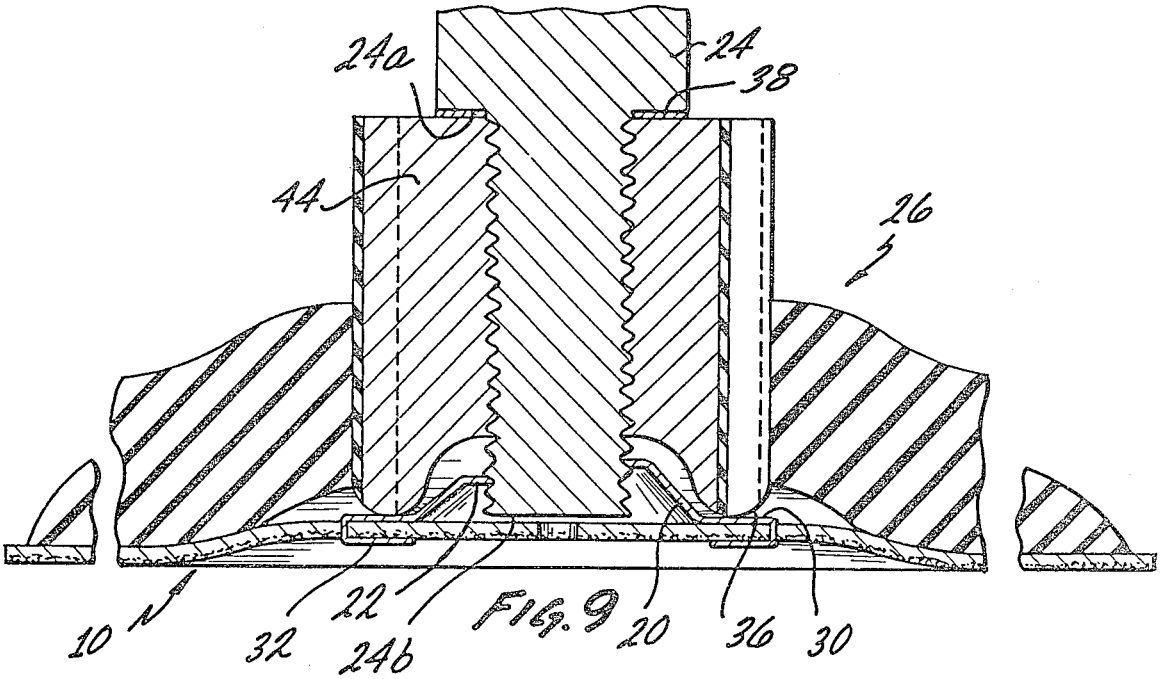
FIG. 9 is an enlarged sectional view of the disc and one embodiment of a support holder for retaining the disc in operative relationship.

The backing member 12 and the abrasive particles 14 are suitably attached to a drive member generally indicated at 18 so as to be driven by the drive member. The drive member includes a boss 20 which is formed to define an internal single-turn thread 22 for receiving an externally threaded stud of a power tool arbor 24 (FIG. 9) in a support holder generally indicated at 26. A flange 30 extends from the bottom of the boss 20 in a direction transverse, and preferably perpendicular, to the boss. Prongs or drive fingers 32 extend outwardly from the periphery of the flange 30 at radially spaced positions around the periphery of the flange.

To fasten the drive member 18 to the backing member 12 and the abrasive particles 14, the drive fingers 32 are extended through the backing member and the abrasive particles. The drive fingers 32 are then bent inwardly into abutting relationship with the abrasive particles on the exposed face of the backing member. In this position, the flange 30 abuts the backing member 12.

The ends of the drive fingers 32 in the embodiments shown in FIGS. 1 through 10 are illustrated as being substantially flat and substantially perpendicular to the lengths of the fingers. The ends of the drive fingers 32 are preferably provided with the configuration of a blunted prong as shown in FIGS. 11 through 14. For example, the ends of the fingers 32 are preferably cut at the corners 33 to define a portion 35 which is somewhat blunt but which extends outwardly from the corners 33. The blunted ends of the fingers act as punches to remove slugs 37 in the backing member. The removal of the slugs 37 by the punching operation occurs without the disposition of any burrs in the backing member. The removal of the slugs without any burrs in the backing member causes sockets having smooth walls to be formed in the backing member.

The disc described above may be attached to the support holder 26 by the single-turn nut defined by the thread 22 screwing on the threaded stud of the power tool arbor 24. In this relationship, a bottom edge of a wall 36 on the holder 26 abuts the flange 30 but the top of the boss 20 preferably does not abut, or at worst hardly grazes, any wall of the support holder. If necessary, washers 38 may be provided between a shoulder **24*a* on the power tool arbor 24 and a bushing 44 in the support holder to assure that the end 24*b* of the arbor stud misses contacting, or barely contacts, the backing member 12. Actually, an even lower friction contact may be provided between the flange 30 and the end of the wall 36 of the support holder 26 by providing a highly polished nose 40** on the surface of the bottom end of said wall.

The disc described above has certain important advantages. It provides for a positive disposition of the disc on the support holder 26 without compressing the disc to convert it, as a practical matter, into a lockwasher. The disc is not compressed because the backing is not engaged by the support holder wall 36. Actually, the support holder wall 36 engages the flange 30, which provides a smooth surface of relatively low friction. This provides for greatly reduced friction in coupling of the disc to the support holder 26. It further provides for an easy removal of the disc from the support holder after the disc has been used in polishing a workpiece. This is true even when a considerable force has been applied to the support holder and the disc to polish the workpiece.

The disc of this invention also has other important advantages. For example, it provides for the attachment of the backing member 12 and the abrasive grains 14 to the drive member 18 without any adherence such as by an epoxy. In the disc of this invention, the drive fingers 32 act to retain the backing member 12 and the abrasive grains 14 and also to drive these members in accordance with the rotation of the support holder.

The disc described above also has other advantages of some importance. For example, the drive fingers 32 are preferably bent inwardly toward the center of the abrasive surface of the sheet 14. When bent, the drive fingers are disposed in flush relationship with the abrasive surface of the sheet 14. This causes the fingers 32 to be disposed in displaced relationship to the work surface of the disc. This work surface generally constitutes the area at or near the periphery of the abrasive surface of the disc.

There are still other advantages to the disc of this invention. When the disc is fastened to the support holder 26, the central portion of the disc tends to be drawn upwardly. This causes essentially only the work area of the disc to be presented to the workpiece. In other words, the central portion of the disc tends to be bent out of planar relationship with the work area of the disc. This is particularly desirable because the inwardly turned ends of the drive fingers 32 are disposed in the area which is drawn upwardly on the support holder 26. This prevents the drive fingers 32 from engaging the workpiece.

The drive member 18 may be made from a suitable sheet metal such as an 18 gauge or 20 gauge steel. The drive member 18 may be initially formed as a blank 50 by a stamping operation. The blank 50 may include a central hole 52, the flange 30 and the drive fingers 32. The hole 52 may then be drawn downwardly to form the boss 20 with the internal single-turn internal thread 22, as shown in FIG. 13. At the same time, the drive fingers 32 may be bent to extend in a direction substantially perpendicular to the flange 30, as shown in FIG. 14.

The blank 50 may then be lifted by a magnet 60 having a pocket 62 shaped to receive the boss 20. In this position, the drive fingers 32 extend downwardly. The magnet 60 is then driven downwardly at a high speed (such as 2000 feet per minute) by a machine such as a punch press to drive the fingers 32 through the backing member 12 and the abrasive grains 14. The punch press is advantageously moved by an air cylinder which is constructed so that the ram will not rotate as the fingers are driven through the backing member 12.

The extension of the fingers 32 through the backing member 12 and the abrasive grains 14 is facilitated by the disposition of a fixture 70 below the abrasive grains 14. The fixture 70 is provided with sockets 72 for receiving the fingers 32 after the fingers have pierced the backing member 12 and the abrasive grains 14.

When the fingers 32 are driven through the backing member 12, the slug 37 is punched cleanly from the backing member 12. This results in part because the fingers 32 are driven at a high speed. It also results from the shaping of the fingers 32 at their outer ends. The slug 37 is punched cleanly from the backing member 12 without any burrs remaining on the backing member. The punching operation is facilitated by the movement of the ends of the fingers 32 into the closely conforming female sockets 72 in the fixture 70. In this way, the sockets 72 act as ties.

Figure 1:
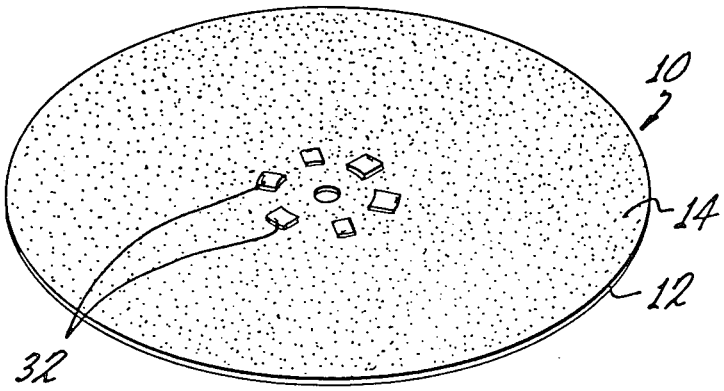
FIG. 1 is a perspective view of a disc constituting one embodiment of the invention, as seen from a position below and to one side of the disc.
Figure 2:
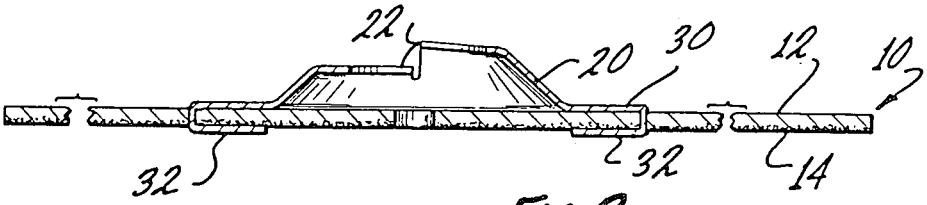
FIG. 2 is an enlarged sectional view of the disc shown in FIG. 1.
Figure 3:
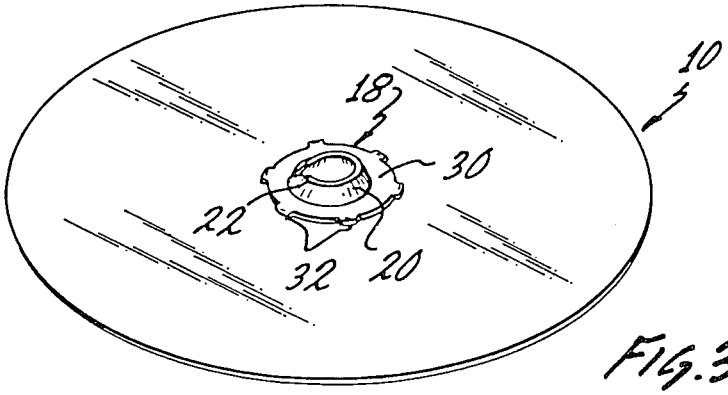
FIG. 3 is an enlarged perspective view of the disc as seen from a position above and to one side of the disc.
Figure 4:
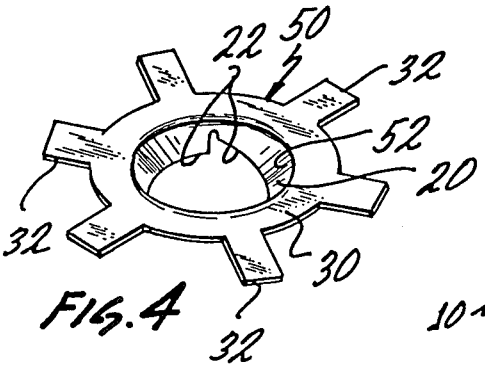
FIG. 4 is a perspective view of a blank before the blank is formed into a drive member which is included in the disc shown in FIGS. 1, 2 and 3.
Figure 5:
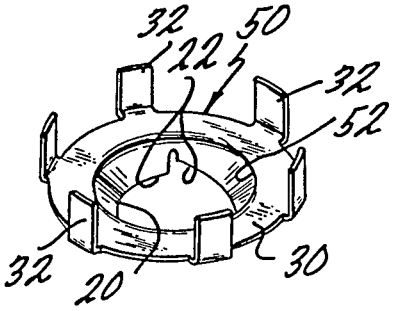
FIG. 5 is a perspective view of the blank shown in FIG. 4 after further operations have been performed on the blank.
Figure 6:
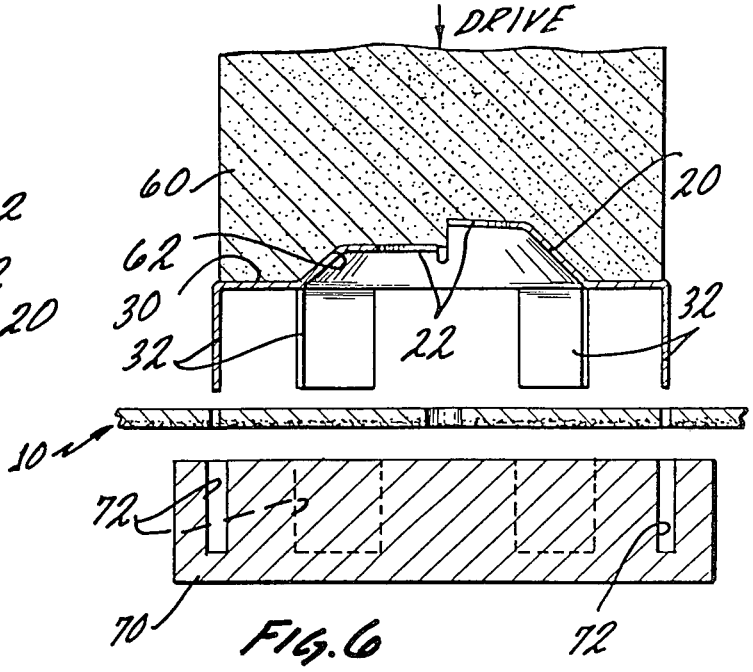
FIG. 6 is a sectional view of the blank shown in FIG. 5 and of fixtures used to provide a first step in assembling the blank into the disc.
Figure 7:
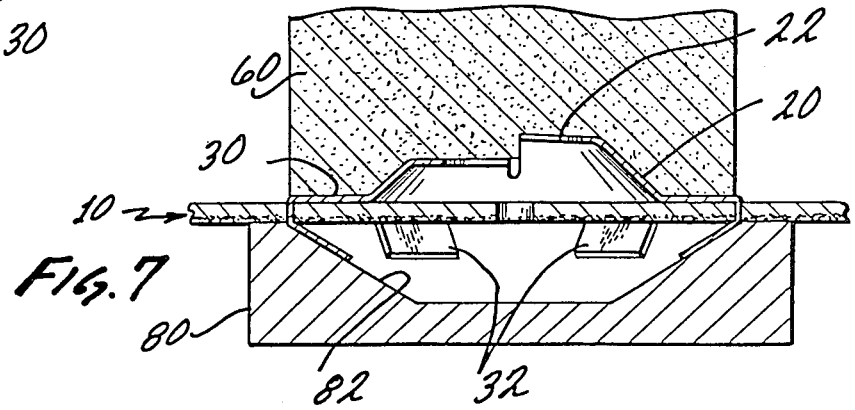
FIG. 7 is a sectional view of the blank and fixtures used to provide an intermediate step in assembling the blank into the disc.
Figure 8:
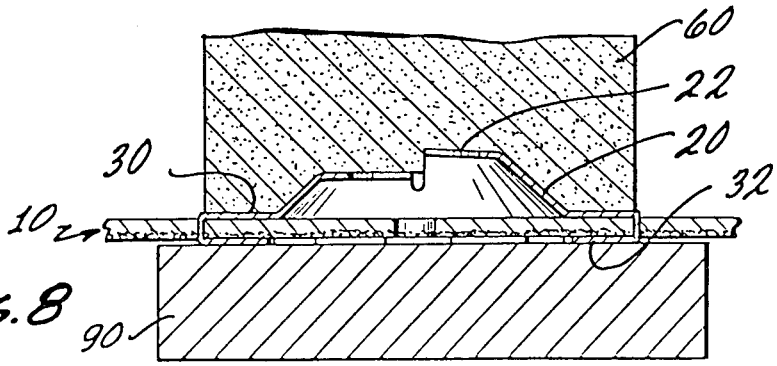
FIG. 8 is a sectional view of the blank and fixtures used to provide a final step in assembling the blank into the disc.

The disc is then retracted from the fixture 70, as shown in FIG. 6 where the disc is shown as being retracted from the fixture, and is replaced by a fixture 80 having a cradle portion 82 shaped to bend the ends of the fingers 32 inwardly when the magnet 60 is driven downwardly against the fixture. In a similar action, the disc is then driven downwardly against another fixture 90 to complete the bending action of the fingers and provide for an abutting relationship of the fingers against the abrasive surface of the sheet 14. The fingers 32 abut against the abrasive surface of the sheet 14 in flush relationship with the sheet 14 because there are no burrs on the sheet. This produces an optimal frictional relationship between the fingers 32 and the sheet 14 so that the fingers 32 are able to drive the sheet.

The apparatus of this invention also has other important advantages. As will be seen, the flange 30 engages the support holder 26 when the disc is attached to the support holder. Since the flange 30 is made from a suitable material such as a smooth sheet of steel, it does not have a large friction. This causes the disc to be easily removed from the support holder after the disc and the support holder have been pressed against a workpiece. This is important because the disc tends to become bound to the support holder by the large forces which are developed when the disc and support holder are pressed against the workpiece.

Another advantage results because the boss 20 does not abut, or at worst hardly grazes, the wall of the support holder. This further tends to minimize the holding force between the support holder and the disc, particularly when the disc is pressed hard against the workpiece. This further facilitates the easy removal of the disc from the support holder after the disc has been inserted on the support holder and has been pressed against the workpiece to polish the workpiece.

Figure 10:
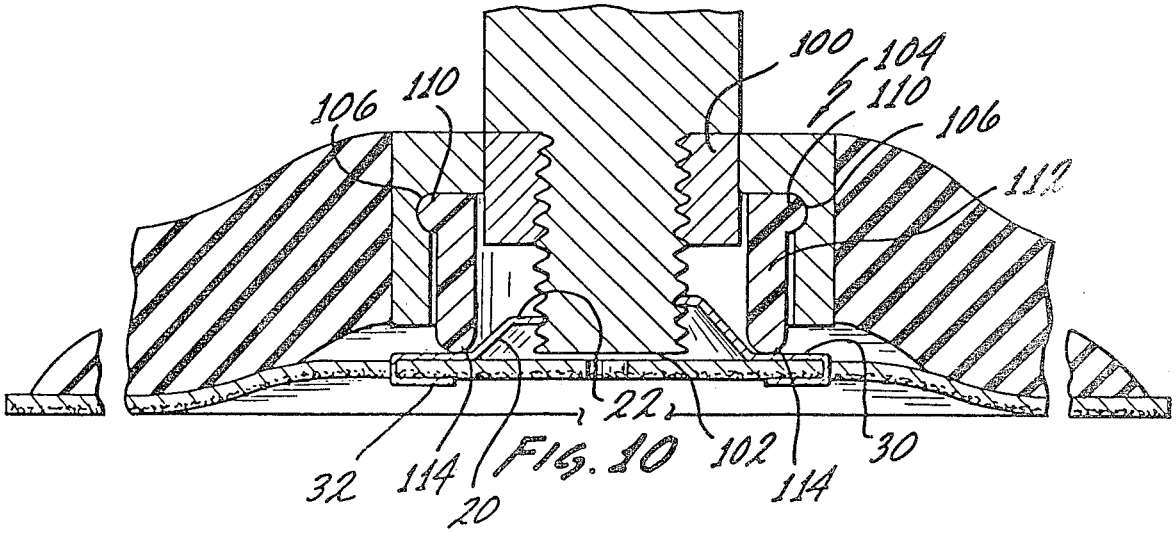
FIG. 10 is an enlarged sectional view of the disc and another embodiment of a support holder for retaining the disc in operative relationship.

FIG. 10 illustrates another embodiment of a support holder. The holder includes a bushing 100 which screws on a powered arbor 102. The arbor receives the screw thread 22 of the boss 20 in a threaded relationship. A retainer 104 is disposed on the bushing 100 as by a pressed fit. The retainer 104 has a detent 106 for receiving an enlarged portion 110 on a collar or snap ring 112. The collar or snap ring 112 may be made from a suitable material, such as a nylon or polytetrafluoroethylene, having properties of providing a low friction. The snap ring 112 envelops the arbor 102 and defines a socket 120 for receiving the boss 20. The snap ring has a nose 114 which contacts the flange 30 of the drive member. As in the embodiment shown in FIG. 9, the crown of the boss 20 does not contact the walls of the socket 120 in the support holder.

Although this application has been disclosed and illustrated with reference to particular applications, the principles involved are susceptible of numerous other applications which will be apparent to persons skilled in the art. The invention is, therefore, to be limited only as indicated by the scope of the appended claims.

We claim:

1. A method of producing an abrasive disc, including the steps of:

providing a backing member having first and second opposite surfaces and abrasive particles adhered to the first surface, forming from a metallic sheet material a drive member having at a central position a boss with a single-turn internal thread, a flange extending from the periphery of the boss and fingers extending from the periphery of the flange and having blunted outer ends, folding the fingers to extend in a direction opposite to the boss and transverse to the flange, directing the fingers through the second surface of the backing member and the first surface of the backing member at a high speed to a position displaced from the first surface of the backing member to remove slugs from the backing member without the formation of burrs in the backing member, and bending against the first surface of the backing member the portions of the fingers displaced from the first surface of the backing member to dispose such portions of the fingers in abutting and flush relationship with the backing member.

2. The method set forth in claim 1 wherein the fingers are bent against the first surface of the backing member at fulcrums corresponding to the first surface of the backing member.

3. The method set forth in claim 2 wherein the portions of the fingers displaced from the first surface of the backing member are bent inwardly toward the center of the backing member.

4. The method set forth in claim 3 wherein the fingers are directed through the backing member into sockets in a first fixture and wherein the fingers are directed against a cradle portion of a second fixture to bend the fingers against the first surface of the backing member.

5. A method of producing an abrasive disc, including the steps of:

providing a backing member having first and second opposite surfaces and having abrasive particles on the first surface, forming from a metallic sheet material a drive member including (a) a flange portion defined by inner and outer ends and having a flat configuration, and including (b) a boss extending in a first direction from the inner end of the flange portion and having a single internal thread at the end opposite the flanged portion, and including (c) fingers extending in a second direction from the outer opposite end of the flange portion and having blunted outer ends, disposing the drive member with the fingers on the flange portion facing toward the second surface of the backing member, driving the fingers through the backing member at a high speed to remove slugs from the backing member without the formation of burrs in the backing member and to obtain a projection of the fingers beyond the first surface of the backing member, and bending the projecting portions of the fingers to a position in abutting and flush relationship with the first surface of the backing member.

6. The method set forth in claim 5 wherein the projecting portions of the fingers are bent in a direction to extend toward one another.

7. The method set forth in claim 6 wherein the fingers are driven through the backing member into sockets in a first fixture disposed adjacent the first surface of the backing member.

8. The method set forth in claim 7 wherein the projecting portions of the fingers are bent against a cradle portion of a second fixture in a direction to obtain a movement of the projecting portions of the fingers toward an abutting and flush relationship with the first surface of the backing member.

* * * * *